US006764055B1

(12) United States Patent
Lee

(10) Patent No.: US 6,764,055 B1
(45) Date of Patent: Jul. 20, 2004

(54) BOOK HOLDING DEVICE WITH MULTI-POSITIONAL SUPPORT ARMATURE

(76) Inventor: David S Lee, 580 Jersey Ave., Apt. 3R, Jersey City, NY (US) 07302

( * ) Notice: Subject to any disclaimer, the term of this patent is extended or adjusted under 35 U.S.C. 154(b) by 0 days.

(21) Appl. No.: 10/349,753

(22) Filed: Jan. 23, 2003

(51) Int. Cl.[7] ..... A47B 97/04

(52) U.S. Cl. ..... 248/451; 248/125.1; 248/288.51; 248/462

(58) Field of Search ..... 248/462, 292.14, 248/288.51, 445, 451, 449, 125.1; 281/42, 43; 116/234

(56) References Cited

U.S. PATENT DOCUMENTS 411,493 A * 9/1889 Ducker ..... 248/451
606,924 A * 7/1898 Hale ..... 248/451
834,262 A * 10/1906 Chrisman ..... 248/442.2
908,751 A * 1/1909 Cooke ..... 248/224.8
1,037,140 A * 8/1912 French ..... 248/457
1,072,534 A * 9/1913 Vosper ..... 248/449
1,579,438 A * 4/1926 Cortelyou ..... 281/42
1,692,337 A * 11/1928 Forbes ..... 248/445
2,134,810 A * 11/1938 Boyle ..... 248/449
2,650,788 A * 9/1953 Hulstein ..... 248/231.71
2,908,465 A * 10/1959 Lykes ..... 248/445
3,790,770 A * 2/1974 Stern ..... 362/98
4,140,296 A * 2/1979 Guzman Guillen ..... 248/445

* cited by examiner

*Primary Examiner*—Korie Chan
(74) *Attorney, Agent, or Firm*—Michael I. Kroll

(57) ABSTRACT

A book holder for releasably retaining a book or document thereon including a base having a vertical support arm extending from the base. The vertical support arm includes a channel extending substantially along a length thereof. A pivoting support arm pivotally connected to said vertical support arm. The pivoting support arm includes a channel extending substantially along a length thereof. The book holder further includes a locking wheel for releasably securing the pivoting support arm to the vertical support arm. A book platform is moveably connected to an end of the pivoting support arm for selectively retaining the book or document thereon in a position able to be easily viewed by a user. Upon releasing the locking wheel, the pivoting support arm is moveable along the length of the channel of the vertical support arm and pivotable about the locking wheel to extend at any desired angle from the vertical support arm and thereby maintain the book platform at a desired position and, upon securing the locking wheel, the pivoting support arm is held in position.

15 Claims, 13 Drawing Sheets

BOOK HOLDING DEVICE WITH MULTI-POSITIONAL SUPPORT ARMATURE

BACKGROUND OF THE INVENTION

1. Field of the Invention

The present invention relates generally to book holders and, more specifically, to a book holding device including a multi-positional support armature for holding a book in place with the book oriented in any desired direction without the need for the user to hold the book.

2. Description of the Prior Art

Numerous other book holding devices known in the art. Typical of these are vertical stands having platforms with a lip at the edge of a platform such as a conventional music stand or podium. While these book holding devices may be suitable for the purposes for which they were designed, they would not be as suitable for the purposes of the present invention, as hereinafter described.

SUMMARY OF THE PRESENT INVENTION

The present invention relates generally to book holders and, more specifically, to a book holding device including a multi-positional support armature for holding a book in place with the book oriented in any desired direction without the need for the user to hold the book.

A primary object of the present invention is to provide a hands-free book holder and support armature that overcomes the shortcomings of the prior art.

Another object of the present invention is to provide a hands-free book holder that can be positioned at any desired angle and retain the book therein.

A further object of the present invention is to provide a hands-free book that is selectively adjustable for accommodating books or documents of varying sizes.

Yet another object of the present invention is to provide a hands-free book holder having spring-loaded page-holding assemblies that apply a bias to press bars for holding down the pages of a book or document.

Still another object of the present invention is to provide a hands-free book holder having a rotatable ball and socket joint connection for securing the book platform to a mobile stand.

Yet another object of the present invention is to provide a hands-free book holder including a pivoting support arm thereby permitting the user to adjust the angle of the book to maximize the readers comfort level.

An even further object of the present invention is to provide a hands-free book holder including a support armature which may be mounted on a fixed base.

Another object of the present invention is to provide a hands-free book holder wherein the support armature may be mounted on a mobile base with caster wheels.

A still further object of the present invention is to provide a hands-free book holder wherein the support armature may be mounted using a vice-type clamp for use with tables, bedposts, etc. or any other suitable mounting element.

Yet another object of the present invention is to provide a hands-free book holder wherein the support armature folds into a compact unit when not in use for convenient storage.

Still another object of the present invention is to provide a hands-free book holder having a clamping mechanism for securing heavy books when used in a downward incline or upside down position.

Yet another object of the present invention is to provide a hands-free book holder that is inexpensive to manufacture and operate.

One more object of the present invention is to provide a hands-free book holder that is simple and easy to use.

Additional objects of the present invention will appear as the description proceeds.

The present invention overcomes the shortcomings of the prior art by providing a hands-free book holder including a support armature that may be used anywhere and allows the reader to place the book in any desired position without having obstructions obscuring the view of the books contents.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
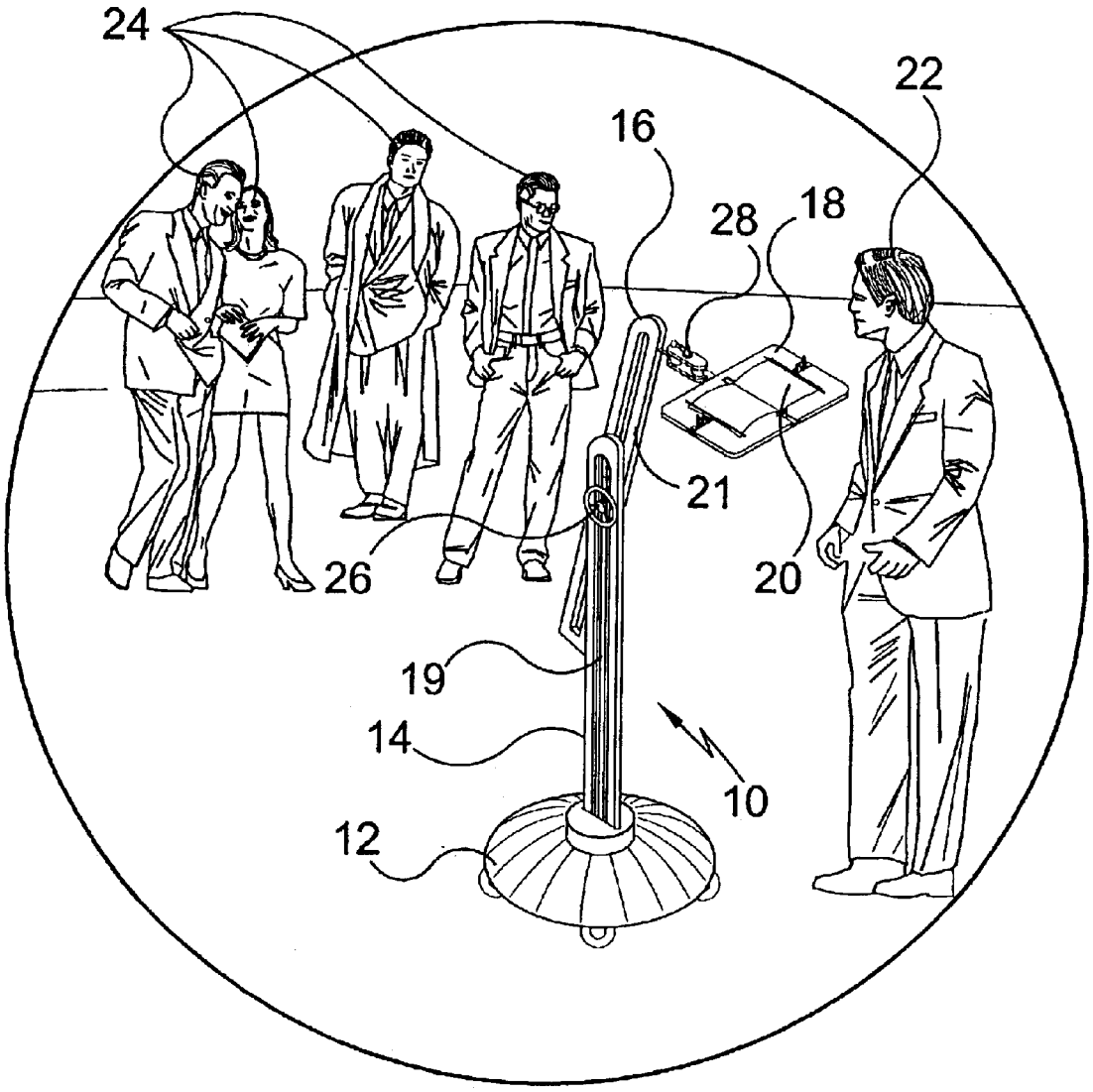
FIG. 1 is an illustrative view of the hands-free book holder of the present invention in use.

Turning now descriptively to the drawings, in which similar reference characters denote similar elements throughout the several views, the Figures illustrate the hands-free book holder. With regard to the reference numerals used, the following numbering is used throughout the various drawing Figures.

10 hands-free book holder of the present invention
11 locking pin
12 base
13 wheel
14 vertical support arm
16 pivoting support arm
18 book platform
19 channel in vertical support arm
20 book/document
21 channel in pivoting support arm
22 user
23 recess in base
24 audience
26 locking wheel
28 clamping member
30 wheel
31 thread
32 washer
33 screw extending from wheel
34 locking nut
35 first wall
36 first clamping ball
37 second wall
38 first socket
39 second socket
40 clamp handle
42 second clamping ball
44 top side of the book platform
45 bottom side of the book platform
46 horizontal track
48 vertical track
49 moveable stopper
50 first page holding mechanism
51 holes
52 second page holding mechanism
53 first bar of book clamp
54 book clamp
55 threads
56 fastener
57 second bar of book clamp
58 press bar
59 screws
60 shaft
61 base of retaining flange
62 tension spring
63 upward extending member of retaining flange
64 retaining flange
65 bar
66 tension spring
68 bar holder
70 teeth
72 thumb screw
73 recess
74 screw thread
76 bias
78 bias
80 vice clamp
82 table
84 couch

DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings in which similar reference characters denote similar elements throughout the several views, FIGS. 1 through 13 illustrated the hands-free book holder of the present invention indicated generally by the numeral 10.

FIG. 1 is an illustrative view of the hands-free book holder of the present invention in use. The hands free book holder 10 allows a user to maintain a book or document 20 in a position of the user's choice. Shown is the book holder 10 of the present invention being used to hold notes for a presentation. The book holder 10 includes a base 12, a vertical support arm 14 extending from the base 12, and a pivoting support arm 16 pivotally connected to the vertical support arm 14. The vertical support arm 14 includes a channel 19 extending along the length thereof and the pivoting support arm 16 is selectively moveable along the length of the channel 19 of the vertical support arm 14. The pivoting support arm 16 also includes a channel 21 extending along the length thereof which allows for many possible positions for the book holder 10. The pivoting support arm 16 is able to be releasably secured into place by a locking wheel 26. The locking wheel 26 may be selectively adjusted to be positioned at any point along the length of the channel 21 of the pivoting support arm 16 thereby adjusting the distance at which the pivoting support arm 16 extends from the vertical support arm 14. A book platform 18 is connected to one end of the pivoting support arm 16 by a clamping member 28 via a ball and socket joint as will be discussed hereinafter with specific reference to FIG. 3. The book platform 18 retains a book or document 20 in a desired position whereby the user 22 is able to clearly view the book or document 20. The book platform 18 is selectively moveable and pivotable to allow the user 22 to angle the platform in a most comfortable position. The book holder 10 of the present invention stands upright on a flat surface and is supported by the base 12. The vertical support arm 14 extends from the base 12 at an angle to the surface on which the base 12 is positioned. The vertical support arm 14 preferably extends at a right angle to the surface on which the book holder 10 is positioned. The pivoting support arm 16 is pivotally connected to extend at a desired angle to the vertical support arm 14. The base 12 of the book holder 10 may also include wheels 13. The wheels 13 allow the book holder 10 to be mobile and easily transportable. The book holder 10 of the present invention permits the user to address the audience 24 without worrying about the position of the book or document being referenced and read from.

Figure 2:
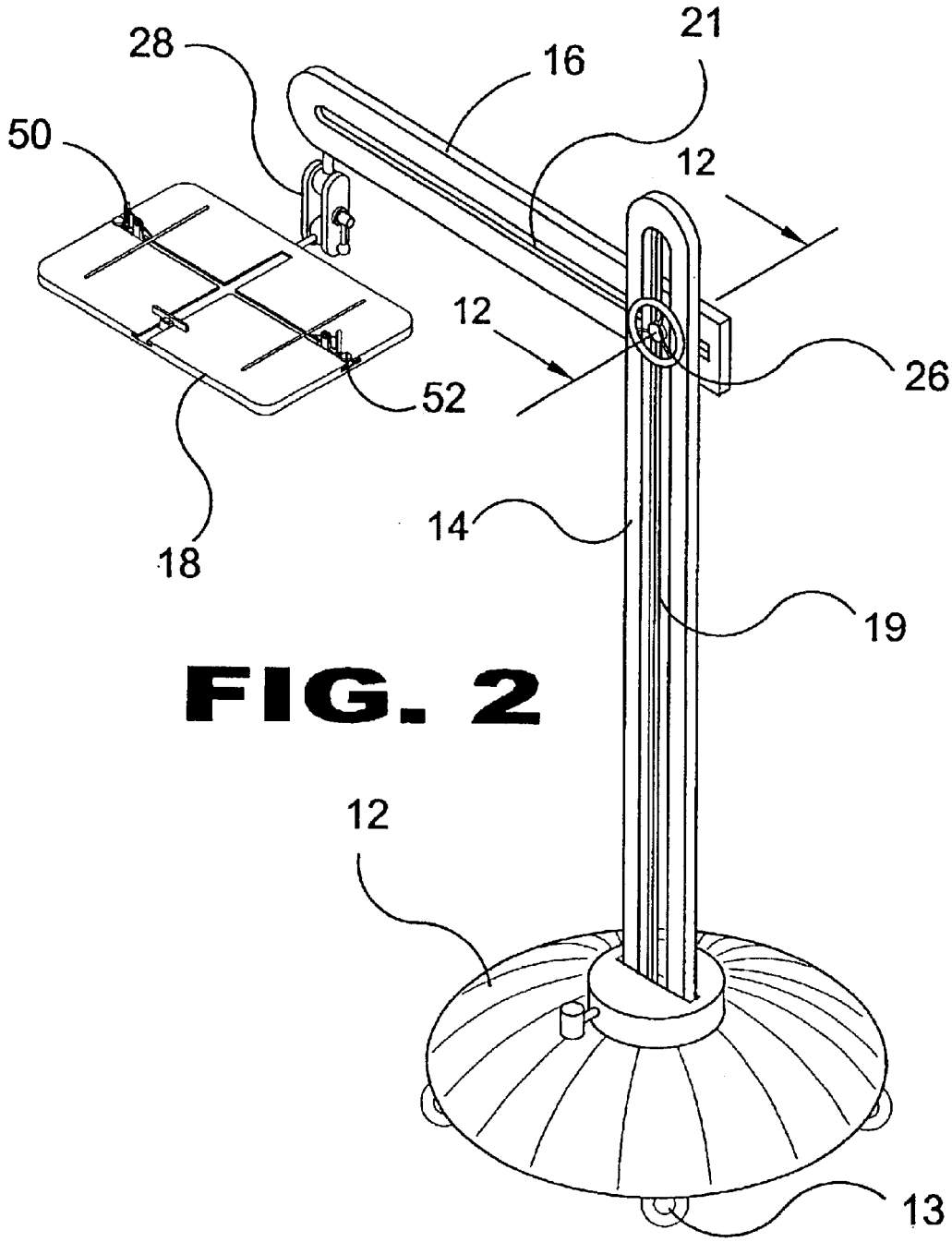
FIG. 2 is a perspective view of the hands-free book holder of the present invention.

FIG. 2 is a perspective view of the hands-free book holder of the present invention. The book holder 10 includes a base 12, a vertical support arm 14 extending from the base 12, and a pivoting support arm 16 pivotally connected to the vertical support arm 14. The vertical support arm 14 includes a channel 19 extending along the length thereof and the pivoting support arm 16 is selectively moveable along the length of the channel 19 of the vertical support arm 14. The pivoting support arm 16 also includes a channel 21 extending along the length thereof which allows for many possible positions for the book holder 10. The pivoting support arm 16 is able to be releasably secured into place by a locking wheel 26. In this figure, the locking wheel 26 has secured the pivoting support arm adjacent a side of the channel 19 in the vertical support arm 14 opposite the base 12 and extending substantially perpendicular to the vertical support arm 14. This position for the pivoting support arm 16 is shown for purposes of example. In use the pivoting support arm 14 may be releasably secured at any desired point along the length of the channel 19 and at any desired angle to the vertical support arm 14. The locking wheel 26 may be selectively adjusted to be positioned at any point along the length of the channel 21 of the pivoting support arm 16 thereby adjusting the distance at which the pivoting support arm 16 extends from the vertical support arm 14. A book platform 18 is connected to one end of the pivoting support arm 16 by a clamping member 28 via a ball and socket joint as will be discussed hereinafter with specific reference to FIG. 3. The book platform 18 retains a book or document 20 in a desired position whereby the user 22 is able to clearly view the book or document 20. The book platform 18 is selectively moveable and pivotable to allow the user 22 to angle the platform in a most comfortable position. The book platform 18 also includes clamps 42 positioned thereon to aid in retaining books, papers or other objects on the book platform 18. The book holder 10 of the present invention stands upright on a flat surface and is supported by the base 12. The vertical support arm 14 extends from the base 12 at an angle to the surface on which the base 12 is positioned. The vertical support arm 14 preferably extends at a right angle to the surface on which the book holder 10 is positioned. The pivoting support arm 16 is pivotally connected to extend at a desired angle to the vertical support arm 14. The base 12 of the book holder 10 may also include wheels 13. The wheels 13 allow the book holder 10 to be mobile and easily transportable.

Figure 3:
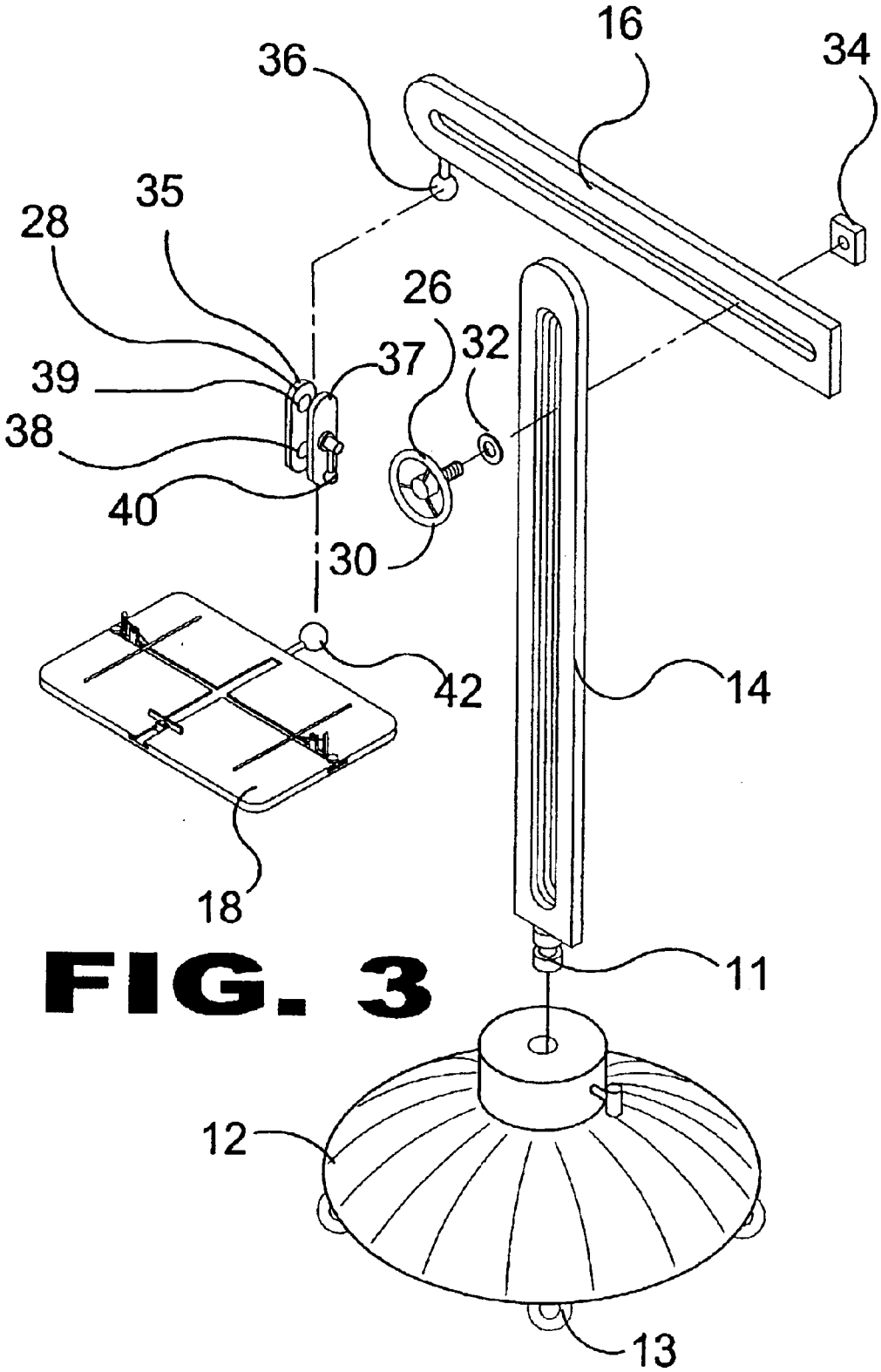
FIG. 3 is an exploded perspective view of the hands-free book holder of the present invention.

FIG. 3 is an exploded perspective view of the hands-free book holder of the present invention. The book holder 10 includes a base 12, a vertical support arm 14 which extends from the base 12, and a pivoting support arm 16 pivotally connected to the vertical support arm 14. The base 12 includes a recess 23 and may have wheels 13 attached thereto on a bottom side there of. The wheels 13 provide the book holder 10 of the present invention with mobility so that it can be moved easily from place to place.

The vertical support arm 14 has a channel 19 extending substantially along the entire length thereof and a locking pin 11 extending from one side thereof The locking pin 11 is received within the recess 23 in the base 12 to secure the vertical support arm 14 in position to the base 12. The pivoting support arm 16 also has a channel 21 extending substantially along the entire length thereof The pivoting support arm 16 is releasably connected to the vertical support arm 14 by a locking wheel 26. The pivoting support arm 16 is selectively moveable along the length of the channel 19 of the vertical support arm 14. The channel 21 of the pivoting support arm 16 allows for the user to selectively adjust the extent to which the pivoting support arm 16 extends from the vertical support arm 14 thereby adjusting the position of the book platform 18. The angle at which the pivoting support arm 16 extends may also be adjusted. When the vertical support arm 14 and the pivoting support arm 16 are in the desired position, the locking wheel 26 releasably secures the vertical support arm 14 and pivoting support arm 16 in place. The locking wheel 26 includes a wheel 30, a screw 33 having a thread 31 extending from the wheel 30, and a locking nut 34. The screw 33 passes through a washer 32 and further through the channel 19 of the vertical support arm 14 and the channel 21 of the pivoting support arm 16. Upon passing therethrough, the wheel 26 is secured in position by securing the locking nut 34 to the screw 33 and thus releasably securing the vertical support arm 14 and pivoting support arm 16 together. The wheel 30 is turned in a clockwise direction until the pivoting support arm 16 and vertical support arm 14 are held together by the locking nut 34 and wheel 30 thereby locking the vertical and pivoting support arms, 14 and 16 respectively, in position.

The book platform 18 is connected to an end of the pivoting support arm 16 by a clamping member 28. A first clamping ball 36 extends from the pivoting support arm 16. A second clamping ball 42 is positioned to extend from a side of the book platform 18. The clamping member 28 includes a first wall 35 and a second wall 37 releasably held together by a clamp handle 40. The first wall 35 includes a first socket 38 and a second socket 39 therein. The clamp handle 40 may loosen the connecting between the first and second walls by turning in a counterclockwise direction. The first clamping ball 36 is received in the first socket 38. The second clamping ball 42 is received in the second socket 39. Upon receipt of the clamping balls 36 and 42, the clamp handle 40 is rotated in a clockwise direction thereby securing the first and second clamping balls 36 and 42 within the first and second sockets 38 and 39, respectively, between the first and second walls 35 and 37, respectively. The book platform 18 is now secured to the pivoting support arm 16. The ball and socket connection used by the book holder 10 of the present invention allows for extreme flexibility when positioning the book platform 18 to easily maneuver the book platform 18 into a comfortable position for the user 22. The clamping member 28 is able to pivot about the first clamping ball 36 and the second clamping ball 42 is able to pivot about the clamping member 28 thereby allowing angular adjustment of the book platform 18. The clamping member 2 is provided for purposes of example only. In practice any type of connection device able to connect the book platform 18 to the pivoting support arm 16 may be used.

Figure 4:
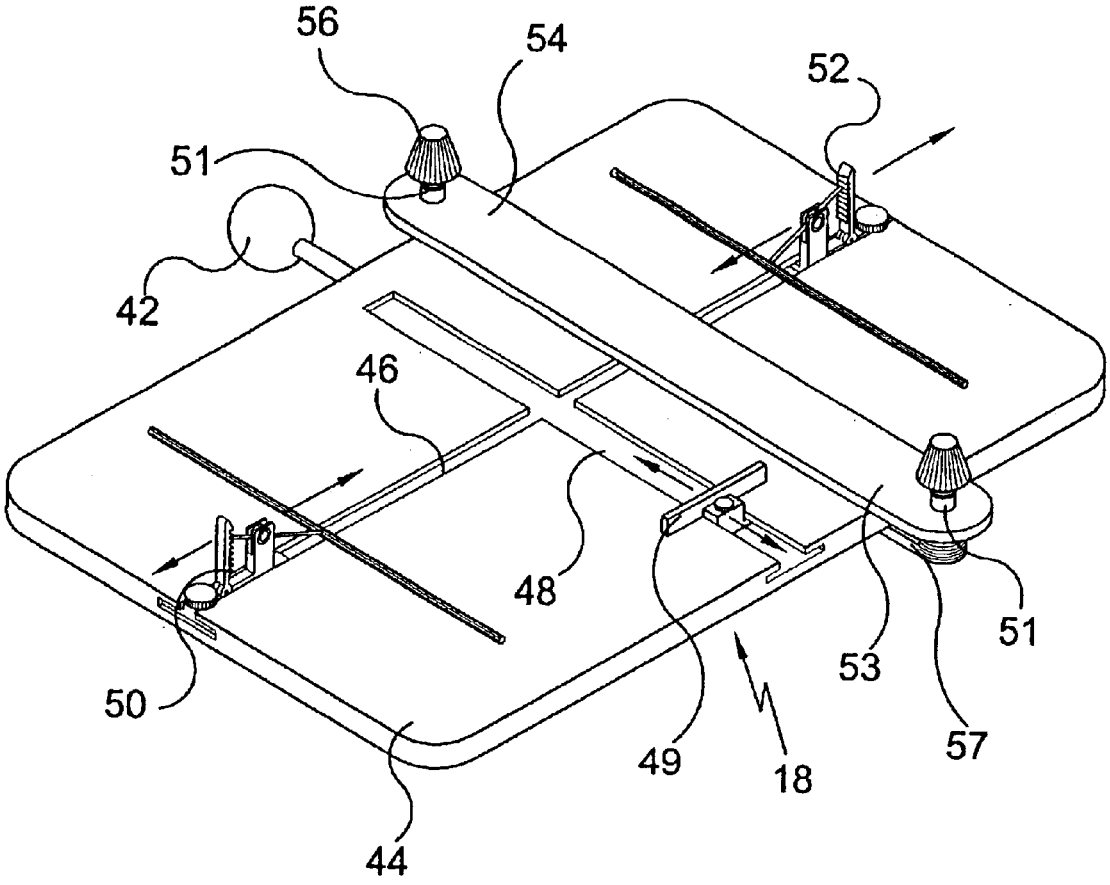
FIG. 4 is a perspective view of the book platform of the hands-free book holder of the present invention including a book clamp.

FIG. 4 is a perspective view of the book platform 18. The book platform 18 has a top side 44 and a bottom side 45. The top side 44 includes a horizontal track 46 extending along a length thereof and a vertical track 48 extending along a width thereof. The horizontal track 46 extends substantially along the entire length of the book platform 18. The vertical track 48 extends from one end of the platform 18 to substantially the other end. The vertical track 48 receives a book stop 49 therein. The book stop 49 is selectively adjustable along the length of the vertical track 48. A book rests on a side of the book stop 49 in order maintain the book in a constant vertical position. The horizontal track 46 receives a first page holding mechanism 50 and a second page holding mechanism 52. The page holding mechanisms 50, 52 are selectively moveable along the track 46 to allow for support of varying sizes of books and/or documents 20. The page holding mechanisms 50, 52 apply a force to the outer perimeter of the book 20 and also the pages thereof. The mechanisms 50, 52, along with the book stop 49 hold the book 20 in place atop the book platform 18 and prevent pages from falling or being blown off the platform. The page holding mechanisms 50,52 will be described hereinafter with specific reference to FIGS. 6 through 8.

A book clamp 54 provides additional support for maintaining a heavy book on the book platform 18. The book clamp 54 includes a first bar 53 extending along the first side 44 of the book platform 18 and a second bar 57 extending along the bottom side 45 and aligned with the first bar 53. The first bar 53 has holes 51 positioned at either end thereof. The second bar 57 includes holes 55 positioned at either end thereof and aligned with the holes 51 in the first bar 53. The second bar 57 is placed against the bottom side 45 of the platform 18. The first bar 53 is positioned so that the holes 51 are in line with the holes 55 in the second bar 57. Screws 55 are provided to extend through the holes 51 of the first bar 53 and the holes of the second bar 57 to thereby releasably secure the first and second bars together. A head of each screw 55 is positioned on side of the first bar 53 opposite the second bar 57. Fasteners 56 are attached to the screw 59 on a side of the second bar opposite the first bar 53 for releasably securing the book clamp 54 to the book platform 18. A book positioned between the first bar 53 and the book platform 18 is held in place when the book clamp 54 is secured in position.

Figure 5:
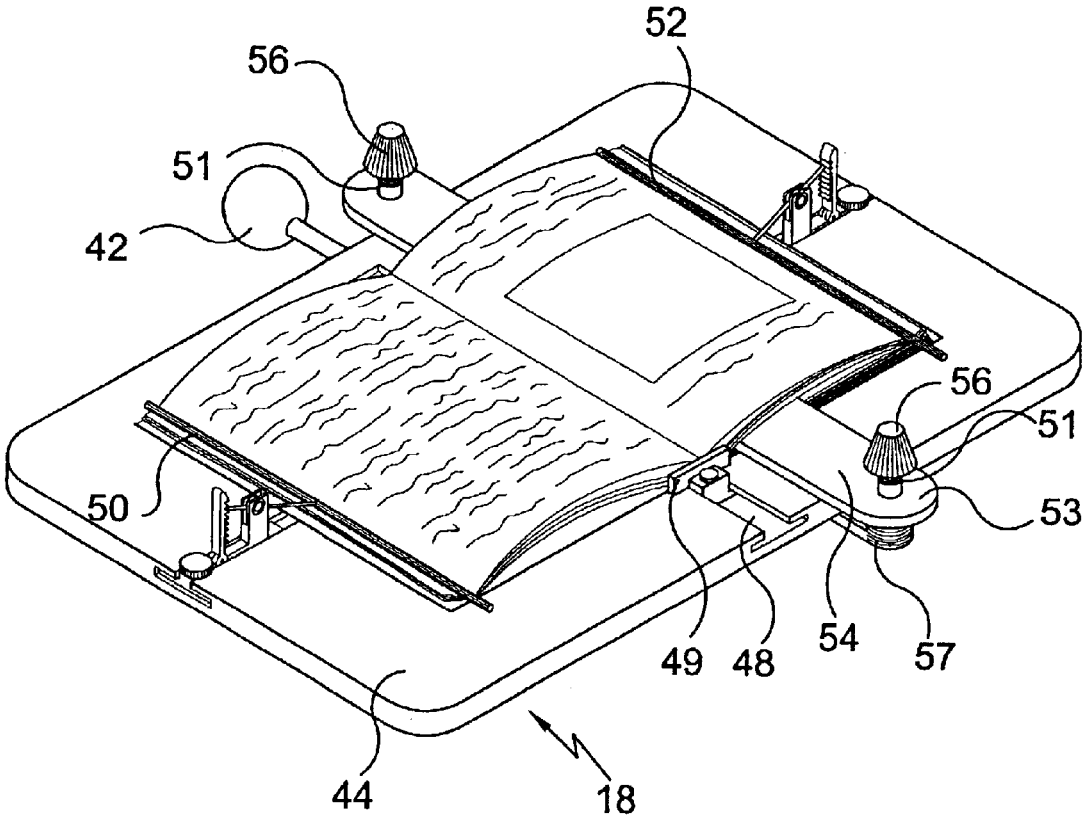
FIG. 5 is a perspective view of the book clamp of the hands-free book holder of the present invention holding a heavy book in place.

FIG. 5 is a perspective view of the book clamp of the book holder of the present invention holding a heavy book in place. A heavy book is first placed atop the platform 18. The page holding mechanisms 50, 52 are adjusted to securely hold the heavy book 20 in place. Thereafter the book clamp 54 is added for extra support. The book clamp 54 includes a first bar 53 which rests atop the first side 44 of the book platform 18 and a second bar 57 extending along the bottom side 45 and aligned with the first bar 53. The first bar 53 has holes 51 positioned at either end thereof The second bar 57 includes holes 55 positioned at either end thereof. The second bar 57 is placed against the bottom side 45 of the platform 18. The first bar 53 is positioned so that the holes 51 are in line with the holes 55 in the second bar 57. Screws 55 are provided to extend through the holes 51 of the first bar 53 and the holes of the second bar 57 to thereby releasably secure the first and second bars together. A head of each screw 55 is positioned on side of the first bar 53 opposite the second bar 57. Fasteners 56 are attached to the screw 59 on a side of the second bar opposite the first bar 53 for releasably securing the book clamp 54 to the book platform 18. A book positioned between the first bar 53 and the book platform 18 is held in place when the book clamp 54 is secured in position.

Figure 6:
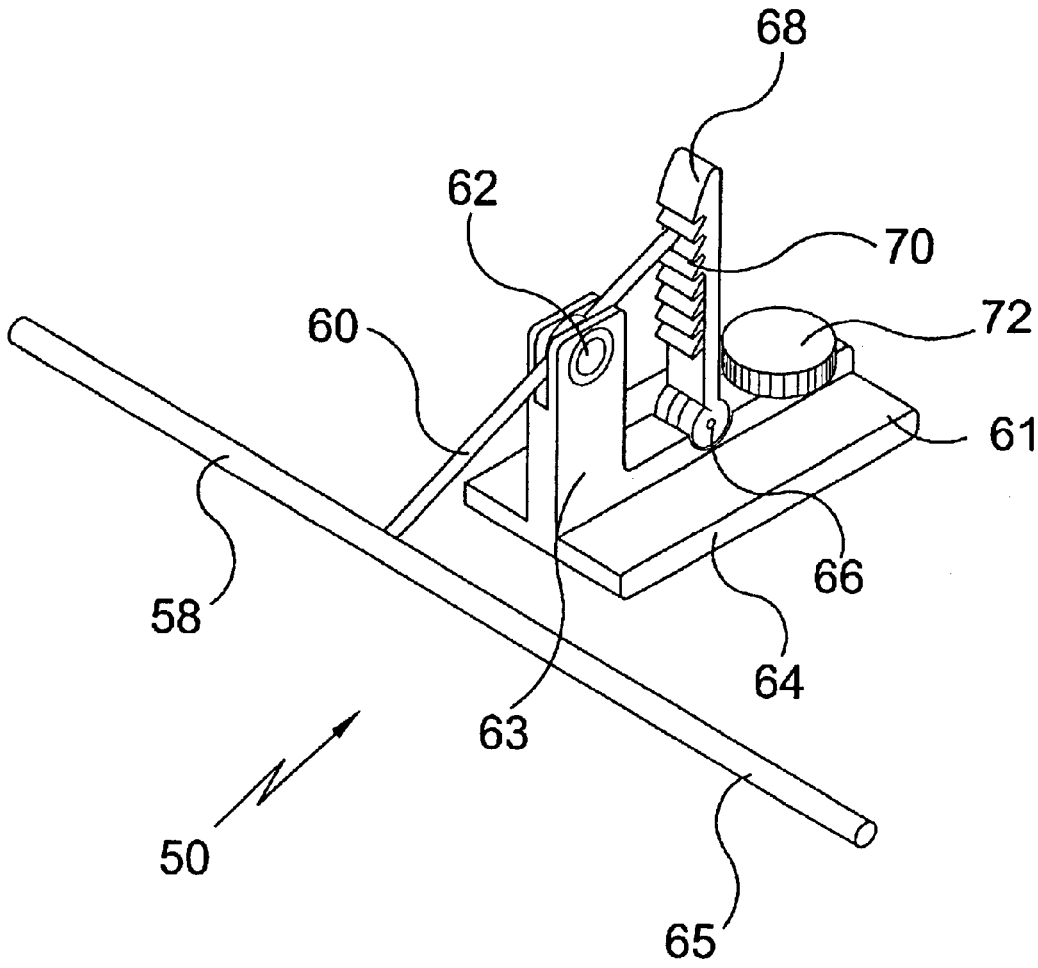
FIG. 6 is a perspective view of a page holding mechanism of the hands-free book holder of the present invention.

FIG. 6 is a perspective view of a page holding mechanism 50 of the hands-free book holder of the present invention. The page holding mechanism 50, includes a retaining flange 64 a thumbscrew, 72 a bar holder 68 and a press bar 58. The retaining flange 64 includes a base 61 and an upward extending member 63 substantially perpendicular to the base 61. The retaining flange further includes a recess 73. The retaining flange 64 is received by the horizontal track 46 in the book platform 18 and allows for movement of the mechanism 50, 52 therealong. The recess 73 of the retaining flange 64 receives the thumbscrew 72 there through. The thumbscrew 72 extends through the recess 73 and into the horizontal track 46 releasably securing the page holding mechanism 50 place at a desired position. The page holding mechanism 50, 52 places a bias against the perimeter of the book 20 and also downward bias on the pages thereof.

A bar holder 68 extends substantially perpendicular from the retaining flange 64 and is pivotally connected to the base 61 by a tension spring 66. The bar holder 68 has a plurality of teeth 70 extending along a side thereof.

The press bar 58 includes a shaft bar 60 and a 65 connected at a first end of the shaft 60 and extending substantially perpendicular thereto. The shaft 60 is pivotally connected to the upward extending member 63 of the retaining flange 64 by a tension spring 62 and is held in position by the bar holder 68. An end of the shaft opposite the connection to the bar 65 is received between adjacent teeth of the bar holder 68. The bar 65 is caused to exert a downward force on the pages of a book 20 positioned between the platform 18 and the bar 65 of the press bar 58 by the combination of the shaft 60, tension spring 62 and bar holder 68. The tension spring 62 allows the shaft 60 to pivot about the upward extending member 63 of the retaining flange 64 to accommodate a book 20 with many pages while biasing the shaft 60 to exert a force on the a bar 65 towards the book platform 18. The bar 65 is thus caused to apply a force against the pages of a book 20 thereby holding the book in place. The end of the shaft 60 opposite the first end rests against the tooth 70 of the bar holder 68. The teeth 70 of the bar holder 68 maintain the shaft 60 of the press bar 58 in place thereby exerting a force on the book and keeping the book 20 securely in place despite the position of the book holder 10 of the present invention.

Figure 7:
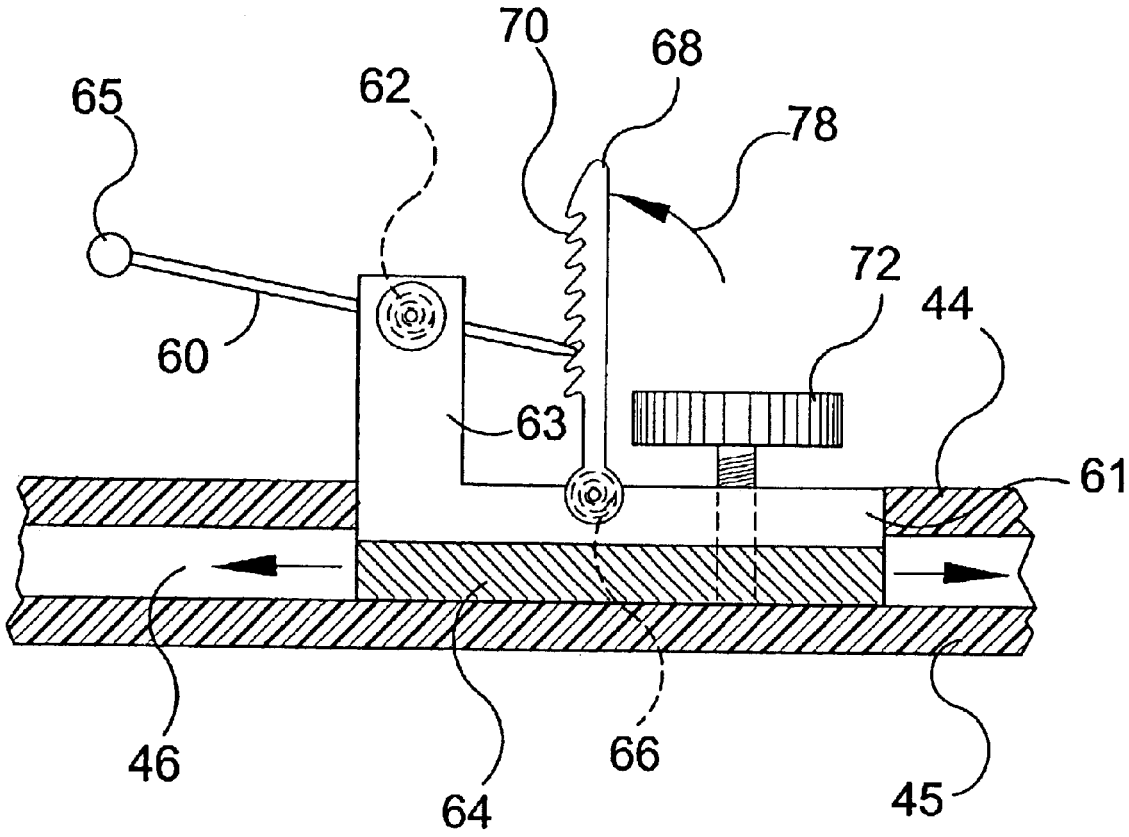
FIG. 7 is a cross-sectional side view of the page holder assembly within the horizontal track of the hands-free book holder of the present invention being adjusted to secure a book.

FIG. 7 is a cross-sectional side view of the page holder assembly within the horizontal track of the hands-free book holder of the present invention being adjusted to secure a book. The page holding mechanism 50, includes a retaining flange 64 a thumbscrew 72, a bar holder 68 and a press bar 58. The retaining flange 64 includes a base 61 and an upwardly extending member 63 substantially perpendicular to the base 61. The retaining flange further includes a recess 73. The retaining flange 64 is received by the horizontal track 46 in the book platform 18 and allows for movement of the mechanism 50, 52 therealong. The recess 73 of me retaining flange 64 receives the thumbscrew 72 there through. The thumbscrew 72 extends through the recess 73 and into the horizontal track 46 releasably securing the mechanism page holding 50, place at a desired position is. The page holding mechanism 50, 52 places a bias against the perimeter of the book 20 and also downward bias on the pages thereof.

A bar holder 68 extends substantially perpendicular from the retaining flange 64 and is pivotally connected the base 61 by a tension spring 66. The bar holder 68 has a plurality of teeth 70 extending along a side thereof.

The bar 58 includes a shaft 60 and a bar 65 connected at a first end of the shaft 60 and extending substantially perpendicular thereto. The shaft 60 is pivotally connected to the upward extending member 63 of the retaining flange 64 by a tension spring 62 and is held in position by the bar holder 68. An end of the shaft opposite the connection to the bar 65 is received between adjacent teeth of the bar holder 68. The bar 65 is caused to exert a downward force on the pages of a book 20 positioned between the platform 18 and the bar 65 of the press bar 58 by the combination of the shaft 60, tension spring 62 and bar holder 68. The tension spring 62 allows the shaft 60 to pivot about the upward extending member 63 of the retaining flange 64 to accommodate a book 20 with many pages while biasing the shaft 60 to exert a force on the bar 65 towards the book platform. The bar 65 is thus caused to apply a force against the pages of a book 20 thereby holding the book in place. The end of the shaft 60 opposite the first end rests between adjacent teeth 70 of the bar holder 68. The teeth 70 of the bar holder 68 maintain the shaft 60 of the press bar 58 in place thereby exerting a force on the book and keeping the book 20 securely in place despite the position of the book holder 10 of the present invention.

The shaft 60 maybe pivoted about the tension spring 62 and lifted from the top side of the platform 18. This causes the shaft to slide down the teeth 70 of the bar holder 68. The bar holder 68 is biased by a direction indicated by the arrow 76. This bias indicated by arrow 76 retains the shaft 60 in position by preventing the shaft 60 from moving upward along the teeth 70 of the bar holder 68. As the shaft 60 moves downward along the teeth 70 of the bar holder 68, the bar holder 68 pivots about the tension spring 66 in a direction indicating by the arrow 78 towards the upward extending member 63 of the retaining flange 64 thereby causing the bar holder 68 to be inclined towards to the extending member 63 of the retaining flange 64. As the shaft 60 moves upward along the teeth 70 of the bar holder 68, the bar holder 68 pivots about the tension spring 66 direction opposite the arrow 78 and away from the upward extending member 63 of the retaining flange 64 thereby causing the bar holder 68 to be positioned substantially perpendicular to the base 61 of the retaining flange 64 or angled away from the extending member 63. This allows for the page holding mechanism 50, 52 to books 20 with a large number of pages and hold it securely in place.

Figure 8:
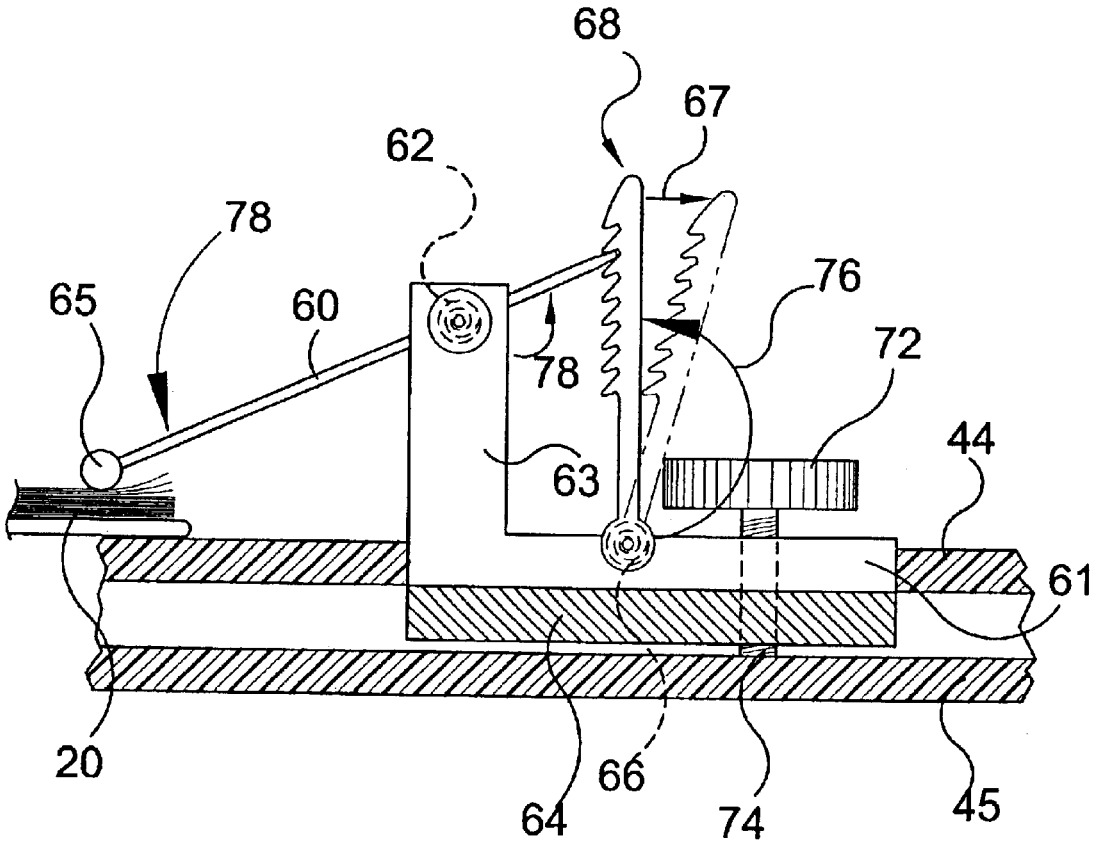
FIG. 8 is a cross sectional side view of the page holder assembly within the track of the hands-free book holder of the present invention holding a book firmly in place.

FIG. 8 is a cross sectional side view of the page holder assembly within the track of the hands-free book holder of the present invention holding a book firmly in place. The page holding mechanism 50, 52 is positioned atop a retaining flange 64. The retaining flange 64 includes a base 61 and an upward extending member 63 substantially perpendicular to the base 61. The retaining flange further includes a recess 73. The retaining flange 64 is received by the horizontal track 46 in the book platform 18 and allows for movement of the mechanism 50, 52 therealong. The recess 73 of the retaining flange 64 receives the thumbscrew 72 there through. The thumbscrew 72 extends through the recess 73 and into the horizontal track 46 releasably securing the page holding mechanism 50, place at a desired position is. The page holding mechanism 50, 52 places a bias against the perimeter of the book 20 and also downward bias on the pages thereof.

A bar holder 68 extends substantially perpendicular from the retaining flange 64 and is pivotally connected the base 61 by a tension spring 66. The bar holder 68 has a plurality of teeth 70 extending along a side thereof.

The press bar 58 includes a shaft 60 and a bar 65 connected at a first end of the shaft 60 and extending substantially perpendicular to the bar 65. The shaft 60 is pivotally connected to the upward extending member 63 of the retaining flange 64 by a tension spring 62 and is held in position by the bar holder 68. An end of the shaft opposite the connection to the bar 65 is received between adjacent teeth of the bar holders. The 65 is caused to exert a downward force on the pages of a book 20 positioned between the platform 18 and the bar 65 of the press bar 58 by the combination on of the shaft 60, tension spring 62 and bar holder 68. The tension spring 62 allows the shaft 60 to pivot about the upward extending member 63 of the retaining flange 64 to accommodate a book 20 with many pages while biasing the shaft 60 to exert a force towards the book platform 18. The bar 65 is thus caused to apply force against the pages of a book 20 thereby holding the book in place. The end of the shaft 60 opposite the first end rests against the tooth 70 of the bar holder 68. The teeth 70 of the bar holder 68 maintain the shaft 60 of the press bar 58 in place thereby exerting a force on the book and keeping the book 20 securely in place despite the position of the book holder 10 of the present invention.

When a book is positioned atop the first side 44 of the platform 18, the press bar 58 is pivoted about the tension spring 62 and raised off the first side 44 of the platform 18. The end of the shaft 60 opposite the bar 65 slides down the teeth 70 of the bar holder 68. When the bar holder 68 is pivoted about the tension spring 66 and moved in a direction illustrated by arrow 67, the press shaft of the press bar 58 pivots about the tension spring 62 thereby causing a bias illustrated by arrow 78 against the book 20. This bias 78 holds the book 20 securely in place. When the bar holder 68 is released so that returns to its original position, the bar holder 68 is biased, as indicated by arrow 76, against the shaft 60 thereby holding the book 20 securely in place.

Figure 9:
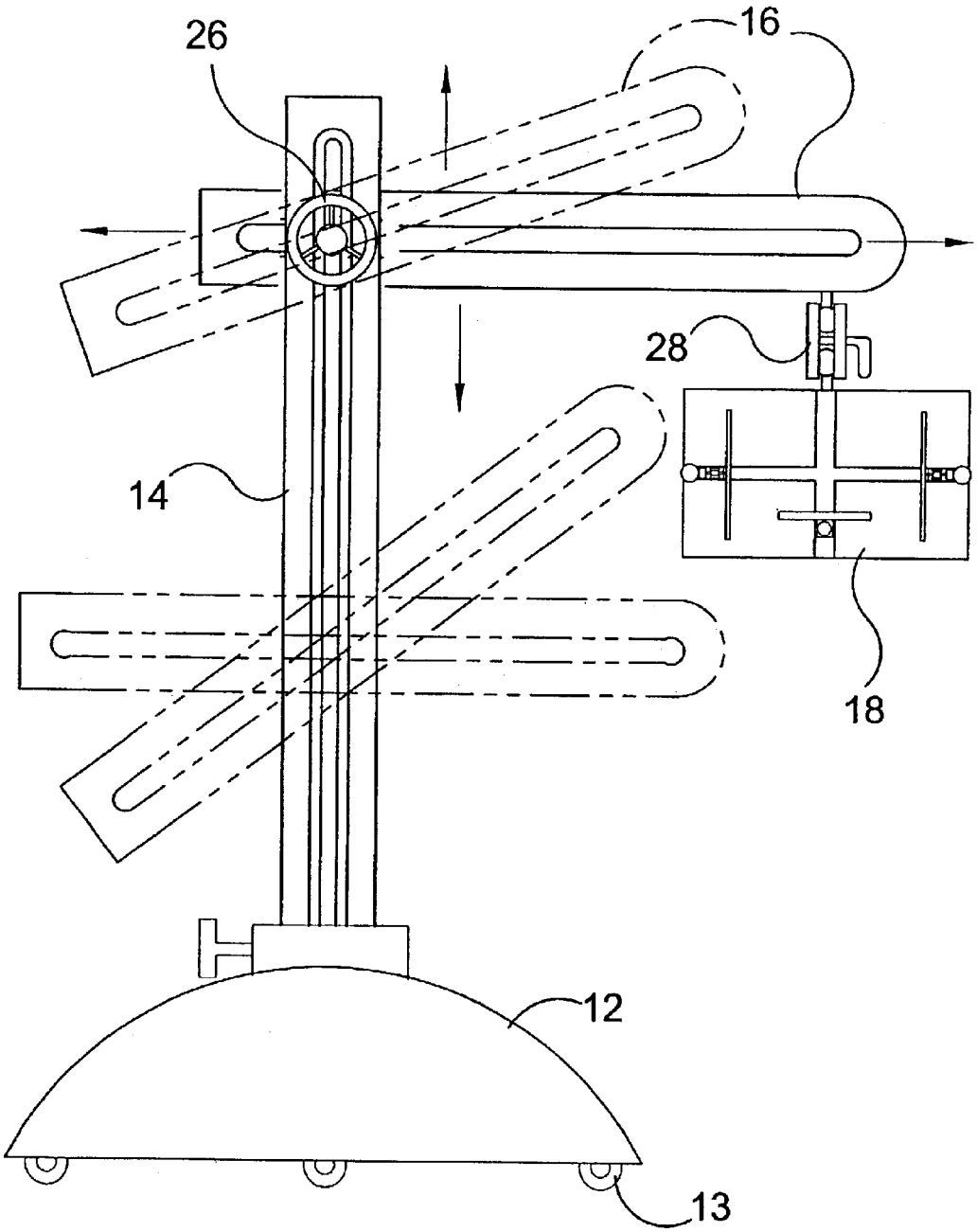
FIG. 9 is a front view of the hands-free book holder of the present invention showing the range of movement for the pivoting support arm.

FIG. 9 is a front view of the hands-free book holder of the present invention showing the range of movements of the pivoting support arm. The book holder 10 includes a base 12, a vertical support arm 14 extending from the base 12, and a pivoting support arm 16 pivotally connected to the vertical support arm 14. The vertical support arm 14 includes a channel 19 extending along the length thereof and the pivoting support arm 16 is selectively moveable along the length of the channel 19 of the vertical support arm 14. The pivoting support arm 16 also includes a channel 21 extending along the length thereof which allows for many possible positions for the book holder 10. The pivoting support arm 16 is able to be releasably secured into place by a locking wheel 26. The locking wheel 26 may be selectively adjusted to be positioned at any point along the length of the channel 21 of the pivoting support arm 16 thereby adjusting the distance of which the pivoting support arm 16 extends from the vertical support arm 14. A book platform 18 is connected to one end of the pivoting support arm 16 by a clamping member 28 via a ball and socket joint as will be discussed hereinafter with specific reference to FIG. 3. The book platform 18 retains a book or document 20 in a desired position whereby the user 22 is able to clearly view the book or document 20. The book platform 18 is selectively moveable and pivotable to allow the user 22 to angle the platform in a most comfortable position. The book holder 10 of the present invention stands upright on a flat surface and is supported by the base 12. The vertical support arm 14 extends from the base 12 at an angle to the surface on which the base 12 is positioned. The vertical support arm 14 preferably extends at a right angle to the surface on which the book holder 10 is positioned. The pivoting support arm 16 is pivotally connected to extend at a desired angle to the vertical support arm 14. The base 12 of the book holder 10 may also include wheels 13. The wheels 13 allow the book holder 10 to be mobile and easily transportable.

Figure 10:
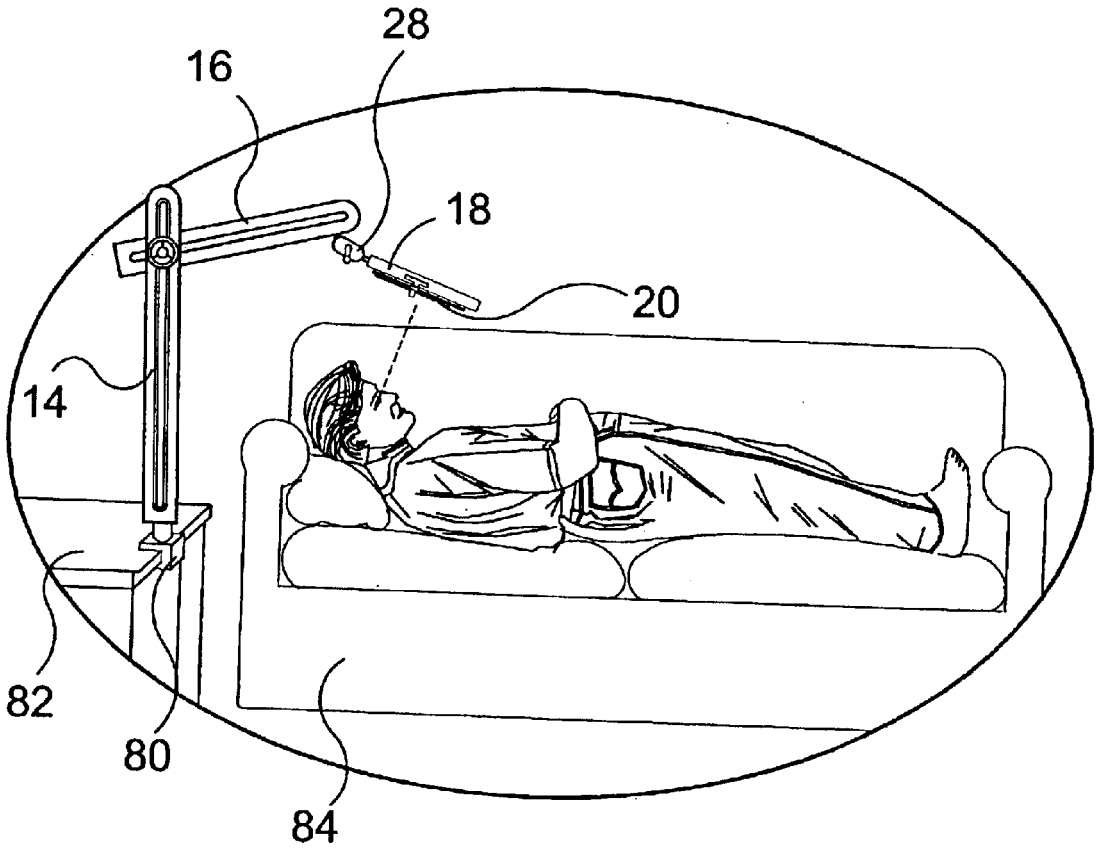
FIG. 10 is an illustrative view of the hands-free book holder of the present invention in use, whereby a user is able to read a book held thereby while lying in a horizontal position.

FIG. 10 is an illustrative view of the hands-free book holder of the present invention in use, whereby a user is able to read a book held thereby while lying in a horizontal position. This alternate embodiment of the book holder 10 includes a vice clamp 80 in place of the base 12. A vertical support arm 14 extends from the vice clamp 80, and a pivoting support arm 16 is pivotally connected to the vertical support arm 14. The vertical support arm 14 includes a channel 19 extending along the length thereof and the pivoting support arm 16 is selectively moveable along the length of the channel 19 of the vertical support arm 14. The pivoting support arm 16 also includes a channel 21 extending along the length thereof which allows for many possible positions for the book holder 10. The pivoting support arm 16 is able to be releasably secured into place by a locking wheel 26. The locking wheel 26 may be selectively adjusted to be positioned at any point along the length of the channel 21 of the pivoting support arm 16 thereby adjusting the distance of which the pivoting support arm 16 extends from the vertical support arm 14. A book platform 18 is connected to one end of the pivoting support arm 16 by a clamping member 28 via a ball and socket joint as discussed herein with specific reference to FIG. 3. The book platform 18 retains a book or document 20 in a desired position whereby the user 22 is able to clearly view the book or document 20. The book platform 18 is selectively moveable and pivotable to allow the user 22 to angle the platform in a most comfortable position. The book holder 10 of the present invention attaches to furniture by the vice clamp 80. However, any item capable of being clamped by a vice clamp 80 can be used to support the book holder of the present invention. The vertical support arm 14 extends from the base 12 at an angle substantially perpendicular to the surface on which the base 12 is positioned. The vertical support arm 14 preferably extends at a right angle to the surface on which the book holder 10 is positioned. The pivoting support arm 16 is pivotally connected to extend at a desired angle to the vertical support arm 14. The vice clamp 80 allows for a user to read a book while lying in a horizontal position.

Figure 11:
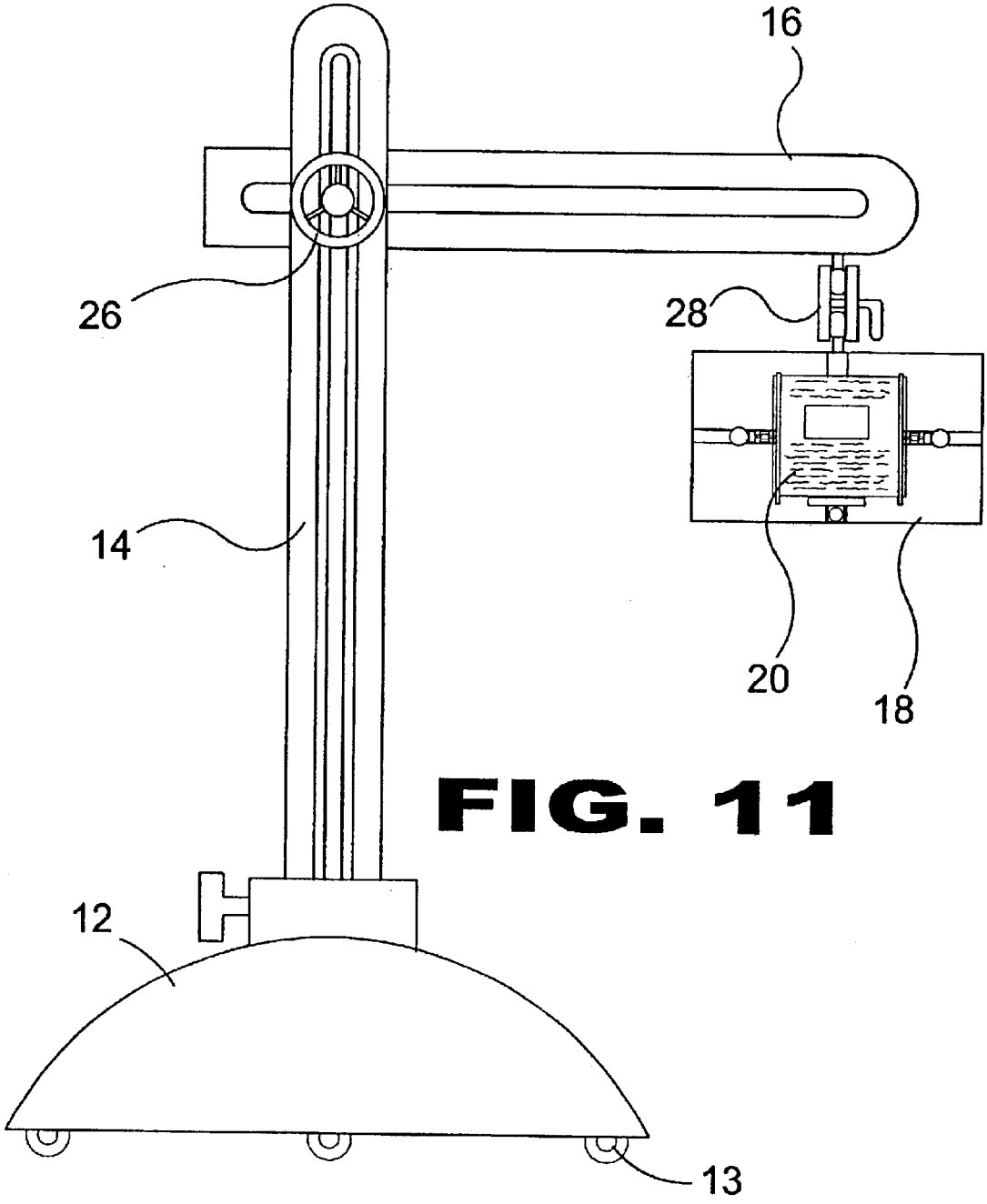
FIG. 11 is a front view of the hands-free book holder of the present invention holding a single page document.

FIG. 11 is a front view of the hands-free book holder of the present invention holding a single page document. The book holder 10 includes a base 12, a vertical support arm 14 extending from the base 12, and a pivoting support arm 16 pivotally connected to the vertical support arm 14. The vertical support arm 14 includes a channel 19 extending along the length thereof and the pivoting support arm 16 is selectively moveable along the length of the channel 19 of the vertical support arm 14. The pivoting support arm 16 also includes a channel 21 extending along the length thereof which allows for many possible positions for the book holder 10. The pivoting support arm 16 is able to be releasably secured into place by a locking wheel 26. The locking wheel 26 may be selectively adjusted to be positioned at any point along the length of the channel 21 of the pivoting support arm 16 thereby adjusting the distance of which the pivoting support arm 16 extends from the vertical support arm 14. A book platform 18 is connected to one end of the pivoting support arm 16 by a clamping member 28 via a ball and socket joint as will be discussed hereinafter with specific reference to FIG. 3. The book platform 18 retains a book or document 20 in a desired position whereby the user 22 is able to clearly view the book or document 20. The book platform 18 is selectively moveable and pivotable to allow the user 22 to angle the platform in a most comfortable position. The book holder 10 of the present invention stands upright on a flat surface and is supported by the base 12. The vertical support arm 14 extends from the base 12 at an angle to the surface on which the base 12 is positioned. The vertical support arm 14 preferably extends at a right angle to the surface on which the book holder 10 is positioned. The pivoting support arm 16 is pivotally connected to extend at a desired angle to the vertical support arm 14. The base 12 of the book holder 10 may also include wheels 13. The wheels 13 allow the book holder 10 to be mobile and easily transportable.

Figure 12:
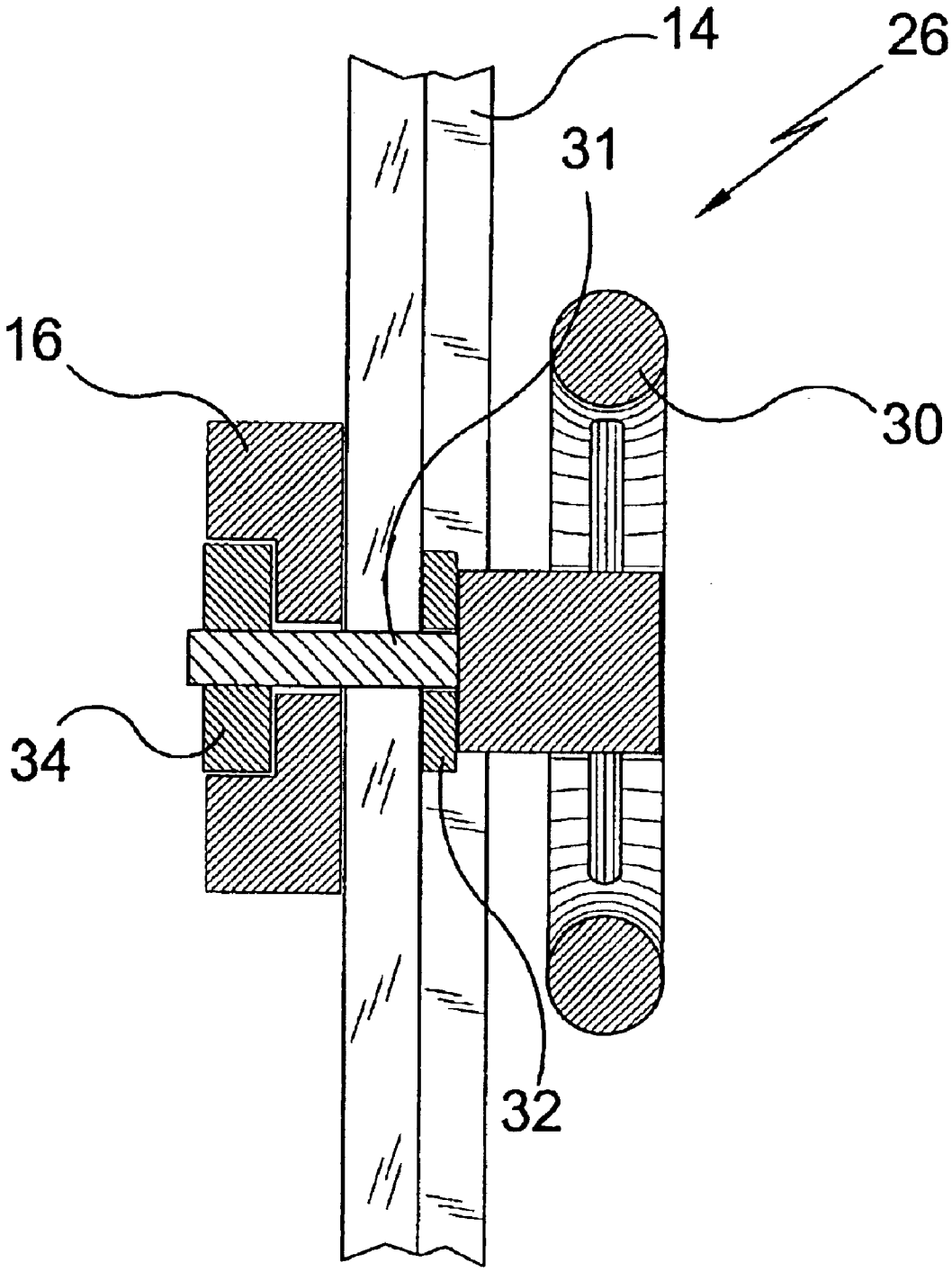
FIG. 12 is a cross sectional view of the arm locking mechanism of the hands-free book holder of the present invention taken along line 12—12 of FIG. 2.

FIG. 12 is a cross sectional view of the arm locking mechanism of the hands-free book holder of the present invention taken along line 12—12 of FIG. 2. As can be seen from this figure, the locking wheel 26 locks the pivoting support arm 16 and the vertical support arm 14 together in a desired position. When the vertical support arm 14 and the pivoting support arm 16 are in the desired position, the locking wheel 26 releasably secures the vertical support arm 14 and pivoting support arm 16 in place. The locking wheel 26 includes the wheel 30 screw 33 having a thread 31 and extending from the wheel 30 and a locking nut 34. The screw 33 passes through a washer 32 and further through the channel 19 of the vertical support arm 14 and the channel 21 of the pivoting support arm 16. Upon passing therethrough, the screw 33 is received by a locking nut 34 and releasably secured in position holding the vertical support arm 14 and pivoting support arm 16 together. The wheel 30 is turned in a clockwise direction until the locking nut 34 is secured against the pivoting arm 16 and the washer 32 is secured against the vertical support arm 14 thereby locking the vertical and pivoting support arms, 14 and 16 respectively, together.

Figure 13:
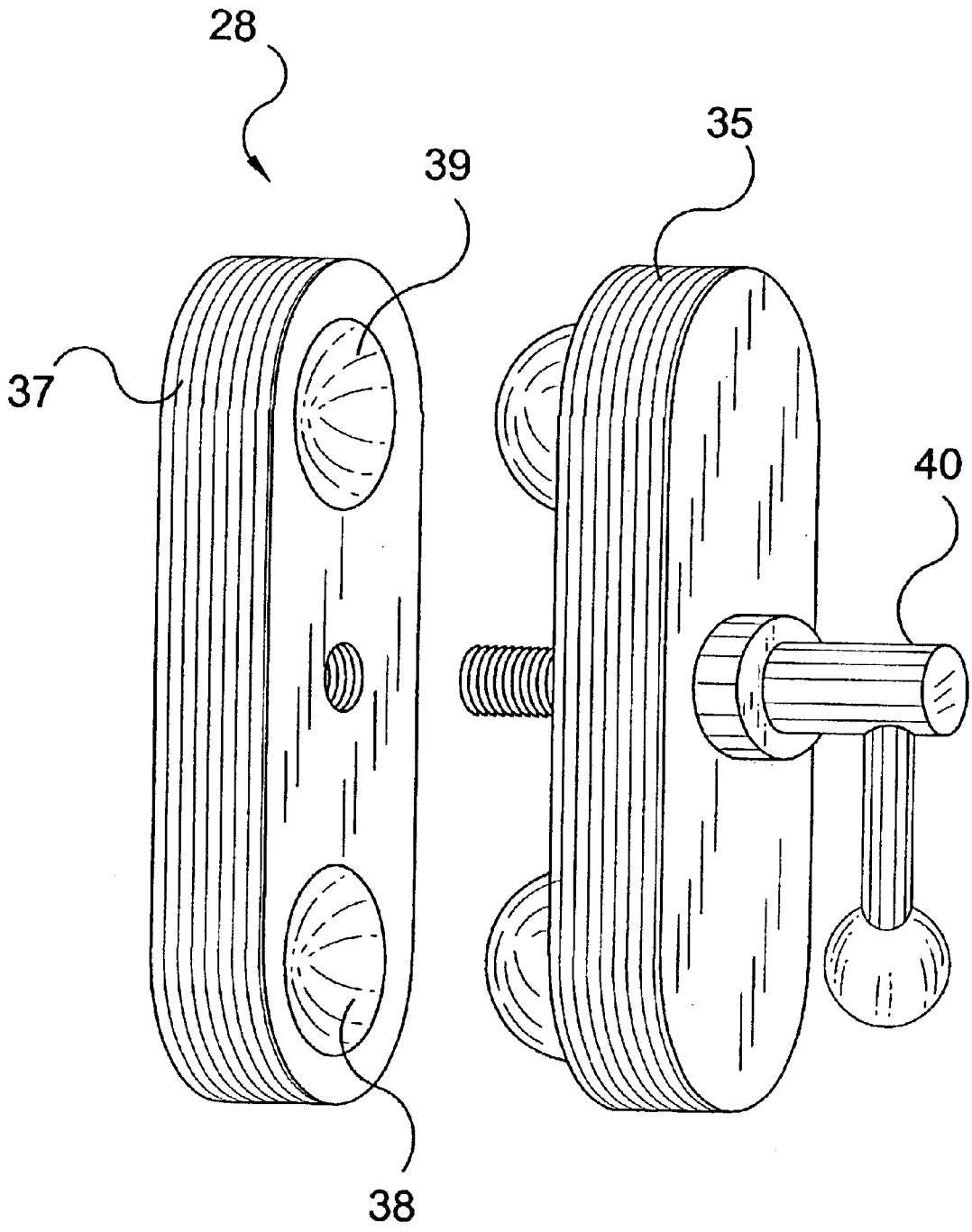
FIG. 13 is a perspective view of the clamping member of the hands-free book holder of the present invention.

FIG. 13 is a perspective view of the clamping member of the hands-free book holder of the present invention. The book platform 18 is connected to an end of the pivoting support arm 16 by a clamping member 28. A first clamping ball 36 extends from the pivoting support arm 16. A second clamping ball 42 is positioned to extend from a side of the book platform 18. The clamping member 28 includes a first wall 35 and a second wall 37 releasably held together by a clamp handle 40. The first wall 35 includes a first socket 38 and a second socket 39 therein. The clamp handle 40 may be loosened by turning in a counterclockwise direction. The first socket 38 receives the first clamping ball 36. The second socket 39 receives the second clamping ball 42. Upon receipt of the clamping balls 36 and 42, the clamp handle 40 is rotated in a clockwise direction securing the first and second clamping balls 36 and 42 within the first and second sockets 38 and 39 respectively, and between the first and second walls 35 and 37 respectively, thereby securing the book platform 18 to the pivoting support arm 16. The ball and socket connection used by the book holder 10 of the present invention allows for extreme flexibility when positioning the book platform 18 to easily maneuver the book platform 18 into a comfortable position for the user 22. The clamping member 28 is able to pivot about the first clamping ball 36 and the second clamping ball 42 is able to pivot about the clamping member 28 thereby allowing angular adjustment of the book platform 18.

The operation of the book holder 10 of the present invention will now be described with reference to the Figures. The book holder 10 of the present invention is used to maintain a book or document in a stationary position. The user 22 selectively moves the book holder 10 of the present invention using the wheels 13 connected to the base 12. When the book holder 10 is moved to its desired position, the armatures of the book holder 10 may be maneuvered 80 that the book holder 10 of the present invention can releasably secure a book 20 in a desired position without the aide of the user.

The locking wheel 26 is turned in a counter clockwise position in order to allow the user 22 to release the pivoting support arm 16 from its position. Upon loosening the locking wheel 26, the pivoting support arm 16 is moveable along the length of the channel 19 of the vertical support arm 14 thereby bringing the pivoting support arm 16 closer or further away from the surfaced on which the base is positioned. The pivoting support arm 16 can also be selectively adjusted to extend a desired distance from the vertical support arm 14 by moving the position of the wheel 76 within the channel 21 of the pivoting support arm. The position of the wheel 26 along the channel 21 defines the pivot point of the pivoting support arm 16. The adjustment along the channel 21 of the pivoting support arm 16 allows for a user 22 to selectively determine the distance the between the user 22 and the book platform 18 of the book holder 10. The pivoting support arm 16 may be pivoted to extend at any desired angle to the vertical support arm. After a user determines the most comfortable height and distance away from the user, the locking wheel 26 is turned clockwise direction in order to secure the pivoting support arm 16 to the vertical support arm 14.

Upon selectively positioning the arms 14, 16 of the book holder 10, the user then places a book or document 20 on the first side of the book platform 18. When the book is placed thereon, the user selective adjusts the vertical book stop 49 along the vertical track 48 to rest against an edge of the book or document 20. The vertical book stop 49 maintains the book or document in position when on the book platform 18.

The page holding mechanisms 50, 52 are then selectively moved along the horizontal track 46 and positioned adjacent to the right and left edges of the book or document 20. The user then lifts the press bar 58 of the first page holding mechanism 50 which pivots about the tension spring 62 and positions a first side of the book 20 thereunder. When the press bar 58 is pivoted about the tension spring 62 away from the book platform, the end of the shaft opposite the bar 65 of the press bar, slides along the teeth 70 of the bar holder 68. The bar holder 68 pivots about the tension spring 66 so as to compensate for the movement and length of the shaft 60 of the press bar 58. When the press is released it will pivot to position the bar 65 over the page positioned thereunder during this movement the bar holder 68 must be held at an angle away from the extending member 63 the bar holder 63 is then released to capture the end of the shaft 60 between adjacent teeth 70 of the barholder. The user then lifts the press bar 58 of the second page holding mechanism 52 which pivots about the tension spring 62 and positions the second side of the book 20 thereunder. When the press is released it will pivot to position the bar 65 over the page positioned thereunder during this movement the bar holder 68 must be held at an angle away from the extending member 63 the bar holder 63 is then released to capture the end of the shaft 60 between adjacent teeth 70 of the barholder. In the position the tension spring 62 causes the press bar 58 to apply a force against the top side of the book 20 resting thereunder.

Upon securing the book to the platform 18, the book clamp 54 to further aide in retaining the book 20 to the platform 18. Specifically, if the book being retained is heavy, the book clamp 54 provides the additional support to keep it in the desired position. The first bar 53 of the book clamp 54 is positioned on a side of an opened book 20 opposite of the book platform 18. The second bar 57 is positioned along the bottom side 45 of the platform 18 whereby the holes in the first and second bars are is aligned. Screws 55 are positioned to extend through the holes 51 of the first bar 53 and the holes 55 of the second bar 57. A head of each screw 55 is positioned on side of the first bar 53 opposite the second bar 57. Fasteners 56 are attached to the screw 59 on a side of the second bar opposite the first bar 53 for releasably securing the book clamp 54 to the book platform 18 thereby releasably securing the book 20 positioned between the first bar 53 and the book platform 18.

Once the book 20 is securely retained atop the book platform 18, the angle of the platform 18 may be adjusted to be in a comfortable position. The book platform is connected to the pivoting support arm 16 via a ball and socket joint. The clamp handle 40 is turned in a counterclockwise direction to loosen the clamping member 28. Upon loosening, the book platform 18 is selectively moveable about the clamping member 28 so that a user may position the book platform 18 at any desired angle. The clamping member 28 pivots about the first clamping ball 36 and the second clamping ball 42. Upon finding the desired position, the clamp handle 40 is turned counterclockwise to tighten the clamping member 28 thereby releasably securing the book platform 18 in position desired by the user 28.

The user 22 may also adjust the position of the platform 18 with respect to the pivoting support arm 16 by moving the clamping member 28 about the first clamping ball 36 extending from the pivoting support arm 16. The clamp handle 40 is turned in a counterclockwise direction to loosen the clamping member 28. Upon loosening, the clamping member 28 is moveable about the first clamping ball 36. The platform 18 can be positioned either above or below the pivoting support arm 16 when the clamping member 28 is pivoted about the first clamping ball. Upon finding the desired position, the clamp handle 40 is turned counterclockwise to tighten the clamping member 28 thereby releasably securing the book platform 18 in position desired by the user 28.

The book holder 10 of the present invention allows for extreme portability and easy manipulation to give a user many configurations so as to allow the user retain a book in a position without the individual physically restraining it thereto.

From the above description it can be seen that the book holder 10 of the present invention is able to overcome the shortcomings of prior art book holders. Furthermore, the present invention is simple and easy to produce and use.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A book holder for releasably retaining a book or document thereon comprising:

a) a base;

b) a vertical support arm extending from said base, and including a channel extending substantially along a length thereof;

c) a pivoting support arm pivotally connected to said vertical support arm, said pivoting support arm having a channel extending substantially along a length thereof;

d) a locking wheel for releasably securing said pivoting support arm to said vertical support arm;

e) a book platform moveably connected to an end of said pivoting support arm for selectively retaining the book or document thereon in a position able to be easily viewed by a user wherein, upon releasing said locking wheel, said pivoting support arm is moveable along the length of said channel of said vertical support arm and pivotable about said locking wheel to extend at any desired angle from said vertical support arm and thereby maintain said book platform at a desired position and upon securing said locking wheel said pivoting support arm is held in position, said book platform including a top side having a horizontal track extending along a length thereof and a vertical track extending along a width thereof; and f) a page holding mechanism received within said horizontal track, wherein said page holding mechanism is selectively moveable along the length of said horizontal track.

2. The book holder of claim 1, wherein said base includes a plurality of wheels positioned on a side opposite said vertical support arm for allowing said book holder to be readily moved to a desired location.

3. The book holder as recited in claim 1, further comprising clamping means, wherein said pivoting support arm includes a first clamping ball extending from the end thereof and said book platform includes a second clamping ball extending therefrom, wherein said clamping means receives said first and second clamping balls for releasably securing said book holder to said pivoting support arm.

4. The book holder as recited in claim 3 wherein said damping means includes a first wall, a second wall, and a clamp handle for releasably connected said first and second walls, said first wall having a first socket and a second socket extending therein for receiving said first and second clamping balls respectively, and said clamp handle is able to tighten said first and second walls of said clamping means together around said first and second clamping balls to secure said platform to said pivoting support arm.

5. The book holder as recited in claim 1, further comprising a book stop received within said vertical track, wherein said book stop is selectively moveable along the length of said vertical track.

6. The book holder as recited in claim 1, further comprising a second page holding mechanism received within said horizontal track, wherein said second page holding mechanism is selectively moveable along the length of said horizontal track.

7. The book holder as recited in claim 1 wherein said page holding mechanism comprises:

a) a retaining flange having a base received within said horizontal track and an upward extending member connected to extend from said base on a side opposite said horizontal track;

b) a first tension spring; and c) a press bar including:

i) a shaft pivotally connected to said upward extending member by said first tension spring; and ii) a bar member connected to a first end of said shaft, wherein said tension spring applies a downward force to said press bar causing said press bar to be biased towards said top side of said book platform thereby retaining said book or document therebetween.

8. The book holder as recited in claim 7, wherein said page holding mechanism further comprises a bar holder having teeth sending along a side thereof, said bar holder being pivotally connected to said base of said retaining flange, wherein an end of said shaft opposite said bar member is releasably secured adjacent teeth of said bar holder for maintaining a position of said press bar to aid in retaining said book or document between sad press bar and said top side of said book platform.

9. The book holder as recited in claim 8, wherein said page holding mechanism further comprises a second tension spring for pivotally connecting said bar holder to said base of said retaining flange.

10. The book holder as recited in claim 7 wherein said page holding mechanism further comprises a thumb screw and said base of said retaining flange includes a recess, wherein said recess receives said thumbscrew for releasably securing said page holding mechanism within said horizontal track.

11. The book holder as recited in claim 1 wherein said book platform includes a book clamp comprising:

a) a first bar extending along said top side of said book platform;

b) a second bar extending along a side of said book platform opposite said top side and aligned with said first bar; and c) means for connecting sad first bar and said second bar for releasably securing said book or document between said first bar and said top side of said book platform.

12. The book holder as recited in claim 11 wherein said first bar has holes extending through either end thereof and said second bar has holes extending through either end thereof, said holes in said first bar being aligned with said holes in said second bar.

13. The book holder as recited in claim 12 wherein said means for connecting said first bar to said second bar is a screw, wherein said holes of said first bar are aligned with said holes of said second bar, and said screw is received by said holes of said first and second bar thereby releasably securing said book or document between said first bar and said top side of said book platform.

14. The book holder as recited in claim 13 wherein said book clamp further comprises a fastener for fastening said screw within the holes on said first and second bars thereby releasably securing said first bar to said second bar.

15. The book holder as recited in claim 1, wherein said locking wheel includes a wheel having a screw extending therefrom, a washer, and a locking nut, whereby said screw passes through said washer, said channel of said vertical support arm, said channel of said pivoting support arm and is received by said locking nut, wherein when said wheel is turned in a clockwise direction said pivoting support arm is secured to said vertical support arm by said wheel.

* * * * *